US005164021A

United States Patent [19]

Kato et al.

[11] Patent Number: 5,164,021

[45] Date of Patent: Nov. 17, 1992

[54] METHOD FOR MANUFACTURING A SHADOW MASK OF A FE-NI ALLOY

[75] Inventors: Jun Kato; Tsuyuki Watanabe; Naofumi Nakamura, all of Hamamatsu, Japan

[73] Assignee: Yamaha Corporation, Hamamatsu, Japan

[21] Appl. No.: 614,252

[22] Filed: Nov. 14, 1990

[30] Foreign Application Priority Data

Nov. 17, 1989 [JP] Japan ..... 1-298825
Nov. 17, 1989 [JP] Japan ..... 1-298826
Dec. 28, 1989 [JP] Japan ..... 1-343210

[51] Int. Cl.[5] ..... C21D 8/12
[52] U.S. Cl. ..... 148/621; 148/635; 148/636
[58] Field of Search ..... 420/9 S; 148/12 A, 12.1

[56] References Cited

U.S. PATENT DOCUMENTS 4,827,178 5/1989 Higashinakagawa et al. ..... 252/512

FOREIGN PATENT DOCUMENTS 3636815 5/1987 Fed. Rep. of Germany .

*Primary Examiner*—Deborah Yee
*Attorney, Agent, or Firm*—Spensley Horn Jubas & Lubitz

[57] ABSTRACT

In composition of a Fe-Ni alloy used for television shadow masks and containing in, Co, Mn, Si and Cr as the major components, additional inclusion of Be assures high deformation resistance and easy pore formation via etching without impairing its inherent low thermal expansion. Introduction of annealing at 800° to 1200° C. temperature into production process sufficiently lowers proof stress of the product without causing any noticeable crystal coarseness. Increased mechanical strength enables production of a thin shadow mask material well suited for pore formation via etching, thereby assuring high grade screen display.

4 Claims, 1 Drawing Sheet

METHOD FOR MANUFACTURING A SHADOW MASK OF A FE-NI ALLOY

BACKGROUND OF THE INVENTION

The present invention relates to a Fe-Ni alloy for shadow masks and a method for producing a shadow mask of such an alloy, and more particularly relates to production of a shadow mask made of a Fe-Ni alloy and used for colour television cathode-ray tubes or the like.

As a substitute for conventional low carbon rimmed steel and aluminum killed steel, invar alloys have recently been used as a material for shadow masks used for colour television cathode-ray tubes in order to meet large size and high grade demands for screen display. As well known, invar alloys are in general given in the form of Fe alloys containing about 36% by weight of Ni and exhibit relatively low thermal expansion.

Use of such invar alloys is proposed for the following reasons. In the case of a cathode-ray tube of a large size and high grade display, high electric voltage is applied to the cathode-ray tube to scan pores in the shadow mask and the amount of energy generated by electron beams impinging upon the shadow mask increases accordingly. When a shadow mask is made of the above-described conventional steels, heat generation caused by impingement of electron beams causes considerable thermal expansion of the shadow mask and such escalated thermal expansion leads to unfit landing of the electron beams on the shadow mask whilst resulting in undesirable colour slide in the screen display. Use of invar alloys removes such troubles thanks to their relatively low thermal expansion.

Despite such a merit, use of invar alloys is accompanied with other problems. Invar alloys are generally low in deformation resistance, i.e. low in Young's modulus. When used for a shadow mask for a television cathode-ray tube, the mask tends to perform resonance with sounds generated by the sound system of the television. In production also, low deformation resistance of invar alloys often induces easy buckling of the shadow mask during assemblage. This buckling problem is becoming very serious with recent trend of thinner shadow mask construction. That is, increasing high precision image display demand for cathode-ray tubes necessitates formation of many fine pores in the shadow masks by means of etching and the thickness of the shadow masks is made thinner and thinner for easy formation of such fine pores. Reduced thickness of the shadow mask allows easy buckling of them during assemblage. Further, prety high proof stress of invar alloys makes them unsuited for pressing process because considerable spring back occurring in pressing process results in defective shape of the products.

SUMMARY OF THE INVENTION

It is the basic object of the present invention to provide a material for a shadow mask which is low in thermal expansion, high in deformation resistance and easy in pore etching.

It is another object of the present invention to provide a material for a shadow mask which is well suited for pressing process.

In accordance with the first aspect of the present invention, a Fe-Ni alloy essentially consists of 30 to 40% by weight of Ni, 3% by weight or less of Cr, 0.01 to 6% by weight of Co, 1% by weight or less of Mn, 0.5% by weight or less of Si, 0.1% by weight or less of B, 0.1% by weight or less of C, 0.01 to 2.0% by weight of Be and Fe in balance.

In accordance with the second aspect of the present invention, a Fe-Ni alloy essentially consists of 30 to 40% by weight of Ni, 0.1 to 1.0% by weight of Cr, 0.01 to 1.0% by weight of Co, 1% by weight or less of Mn, 0.5% by weight or less of Si, 0.001 to 0.01% by weight in total of one of Ti, Zn, Nb, Al, Be and B, and Fe in balance.

In accordance with the third aspect of the present invention, a method for producing a shadow mask of one of the above-described Fe-Ni alloys comprises steps of preparing a plate from the Fe-Ni alloy, forming fine pores in the plate by means of etching, annealing the plate at a temperature in a range from 800° to 1200° C. for 5 min. or longer within an inert gas or hydrogen gas environment, and applying plastic deformation to the plate at a temperature of 300° C. or lower.

DESCRIPTION OF THE PREFERRED EMBODIMENTS

Figure 1:
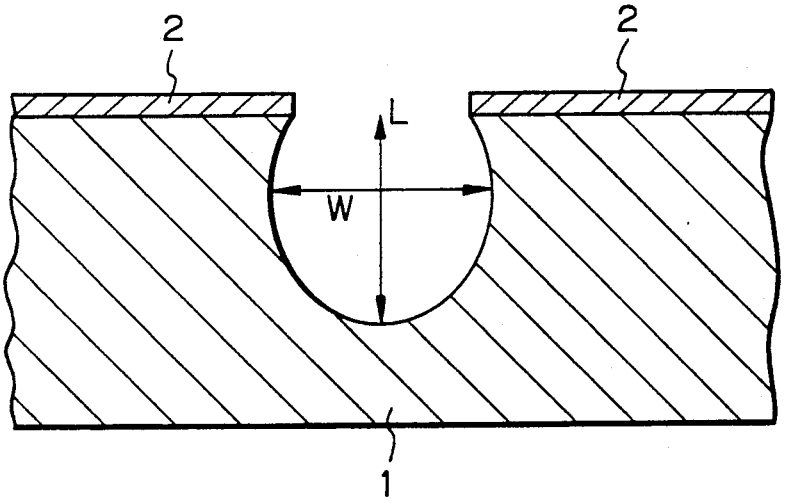
FIG. 1 is a sectional side view for explaining factors in etching process in the method of the present invention.

According to the first aspect of the present invention, the Fe-Ni alloy essentially consists of 30 to 40% by weight of Ni, 3% by weight or less of Cr, 0.01 to 6% by weight of Co, 1% by weight or less of Mn, 0.5% by weight or less of Si, 0.1% by weight or less of B, 0.1% by weight or less of C, 0.01 to 2.0% by weight of Be and Fe in balance.

Limited inclusion of Ni in the alloy composition keeps inherent low thermal expansion of the alloy. When the content of Ni falls outside the specified limits, raised thermal expansion leads to the problem of colour slide in screen display.

Presence of Cr in the alloy composition much improves deformation resistance (Young's modulus) of the alloy and lowers proof stress (yield strength) of the alloy after annealing, but any content of Cr beyond the specified limit impairs its inherent low thermal expansion.

Presence of Co in the alloy composition assures easy pore formation via etching. But any content of Co outside the specified limits leads to raised thermal expansion whilst causing the problem of colour slide in screen display also.

Mn is added to improve fitness of the alloy to hot forging. Mn also acts as a deoxidizing agent. Excessive inclusion of Mn, however, impairs its initial low thermal expansion.

Si acts as a deoxidizing agent. Excessive inclusion tends to made the resultant product fragile.

Presence of B in the alloy composition much improves its fitness to hot working. Any content of B beyond the specified limit impairs low proof stress after annealing.

Inclusion of C beyond the specified limit causes thermal expansion and disenables easy pore formation via etching.

Be is added to raise mechanical strength of the product. No appreciable rise in strength can be observed when its content falls short of 0.01 by weight. Any content above the upper limit cannot be recommended from the viewpoint of cost and performance.

In one embodiment of the above-described first aspect of the invention, the alloy contains 30 to 34% by weight of Ni and 4 to 6% by weight of Co. In the other embodiment, the alloy contains 30 to 40% by weight of Ni and 0.01 to 2% by weight of Co.

In either combination, rise in mechanical strength caused by inclusion of Be has significance. Increased mechanical strength of the alloy allows use of a thin shadow mask and the reduced thickness allows easy formation of fine pores via etching, thereby providing television shadow masks of specially high grade in screen display. Addition of Be may more or less mar fitness to pressing process. This disadvantage can, however, be well covered by the recent progress in hot pressing technique. As a consequence, there is no substantial problem in practice in addition of Be to the alloy composition.

According to the second aspect of the present invention, the Fe-Ni alloy essentially consists of 30 to 40% by weight of Ni, 0.1 to 1.0% by weight of Cr, 0.01 to 1.0% by weight of Co, 1% by weight or less of Mn, 0.5% by weight or less of Si, 0.001 to 0.01% by weight in total of one of Ti, Zn, Nb, Al, Be and B, and Fe in balance.

Inclusion of Ti, Zn, Nb, Al, Be and/or B is proposed to improve fitness of the alloy to hot working. Any content below the lower limit assures no appreciable merit but excessive content cannot be recommended from the viewpoint of cost and performance.

According to the third aspect of the present invention, the method for producing a shadow mask of one of the above-described Fe-Ni alloys comprises steps of preparing a plate from the Fe-Ni alloy, forming fine pores in the plate by means of etching, annealing the plate at a temperature in a range from 800° to 1200° C. for 5 min. or longer within an inert gas or hydrogen gas environment, and applying plastic deformation to the plate at a temperature of 300° C. or lower.

In one embodiment of the above-described third aspect of the invention, materials are mixed in accordance with one of the above-specified compositions and, in order to remove inclusion of impurities, the mixture is molten in an inert gas environment such as nitrogen gas chamber to obtain an alloy ingot.

Next, the ingot is forged at a temperature in a range from 1200° to 1400° C. in order to form the same into a plate at a work ratio of, for example, 70%.

In formation of fine pores, a perforated protective wafer (a Perforated resist film) is formed on the surface of the plate, the plate is immersed into an etching bath and the protective wafer is removed.

The plate is next annealed at a temperature in a range from 800° to 1200° C. for 5 to 60 min. within an inert gas or hydrogen gas environment. This annealing process lowers proof stress of the plate without causing any noticeable crystal coarseness.

After the annealing, the plate is subjected to pressing at a temperature in a range from the room temperature to 300° C.

When annealed at a temperature below the lower limit, no sufficient improvement in lowering proof stress deformation resistance is expected. Whereas, when annealed at a temperature beyond the upper limit, resultant crystal coarseness makes the product fragile. Any annealing time shorter than 5 min. assures no uniform annealing effect and any annealing time longer than 60 min. mars productivity of the process. Pressing at a temperature above 300° C. causes ill lubrication between the plate and the die.

DESCRIPTION OF EXAMPLES

Example 1

Using alloys having compositions shown in Table 1 ingots were prepared by melting the alloys in a vacuum environment of 80 Torr. containing Ar gas.

Next each ingot was subjected to hot forging at a temperature between 1200° and 1400° C. followed by alternate rollings at a working ratio of 70% or smaller and annealings at temperatures between 800° and 1100° C. In each annealing, heating was followed by slow cooling. The ingot was formed into a plate of 0.15 mm thickness by the final rolling. Using various alloys shown in the Table 1, Samples Nos. 1 to 8 were prepared in a same way. Each sample was subjected to annealing within $H_2$ gas environment by heating at 1050° C. for 30 min. and subsequently cooling slowly.

Then, the samples were subjected to measurement of mechanical properties and thermal expnasivity, the result of the measurements being shown in Tables 1 and 2.

It is clear from the data in the Tables that the Samples Nos. 2 to 6 containing Be in accordance with the present invention are much improved in tensile strength, and hardness when compared with Samples No. 1 (conventional sample) and Nos. 7 and 8 (comparative samples). Thermal expansion is also kept acceptably low and proof stress is in acceptable level.

The Be contents of Samples Nos. 7 and 8 fall outside the specified range of the present invention. Sample 7 is insufficient in improvement in strength due to its low content of Be whereas Sample No. 8 exhibits considerably high thermal expansion due to its excessive content of Be.

The data well support advantageous inclusion of Be proposed by the present invention.

Example 2

Using alloys having compositions shown in Table 3 ingots were prepared by melting the alloys in a vacuum environment of 80 Torr. containing Ar gas.

Next each ingot was subjected to hot forging at a temperature between 1200° and 1400° C. followed by alternate pressings at a working ratio of 70% or smaller and annealings at temperatures between 800° and 1100° C. In each annealing, heating was followed by slow cooling. The ingot was formed into a plate of 0.15 mm thickness by the final pressing. Using various alloys shown in the Table 3, Samples Nos. 11 to 21 were prepared in a same way. Each sample was subjected to annealing within $H_2$ gas environment by heating at 1050° C. for 30 min. and subsequently cooling slowly.

Then, the samples were subjected to measurement of mechanical properties, thermal expnasivity (thermal sxpansion coefficient) and etching fitness (etch factor), the result of the measurements being shown in Tables 3 and 4.

For measurement of etching fitness, a protective wafer 2 is formed on the surface of a sample plate 1 as shown in FIG. 1. After formation of fine pores via etching the ratio of the maximum depth L with respect to the maximum diameter W of a pore formed in the sample plate was indicated by a etching factor which is shown in last column in Table 4.

It is clear from the data in the Tables that the Samples Nos. 18 to 20 containing Be in accordance with the present invention are much improved in tensile strength, hardness and etching fitness when compared with Samples No. 11 (conventional sample) and Nos. 12 to 16 (comparative samples). Thermal expansion is also kept acceptably low.

The Be contents of Samples Nos. 17 and 21 fall outside the specified range of the present invention. Sample 17 is insufficient in improvement in strength due to its low content of Be whereas Sample No. 21 exhibits considerably high thermal expansion due to its excessive content of Be.

The data well support advantageous inclusion of Be proposed by the present invention.

Example 3

Using alloys having compositions shown in Table 5 ingots were prepared by melting the alloys in a vacuum environment containing nitrogen gas. The ingots were subjected to hot forging to obtain Samples Nos. 32 to 36 in the form of plates. The result of thermal expanasivity measurement is shown in the last column in Table 5. Cr content of Sample No. 36 is 1.8% by weight which falls outside the range proposed by the present invention and, as a consequence, this Sample exhibits too high thermal expansion.

Next, each sample was subjected to annealing at 900° and 1100° C. to obtain subsamples such as Samples Nos. 311 to 313 shown in FIG. 6. Each subsample was then subjected to measurement of 0.2% proof stress and Young's modulus. In the case of Samples Nos. 321 to 324, 0.2% proof stress and Young's modulus after 700° C. annealing are also measured. The result of the measurement is shown in Table 6.

Subsamples such as Nos. 315 etc. annealed at 1100° C. were subjected to measurement of 0.2% proof stress at 100° and 200° C. and the result is shown in Table 7.

It is clear from the data in the Tables that Samples without annealing are too large in proof stress but Samples subjected to annealing exhibit low proof stress with sufficient highlevel of Young's modulus.

TABLE 1

| Sample | Kind | Ni | Co | Cr | Mn | Si |
|---|---|---|---|---|---|---|
| 1 | B | 32.0 | 5.1 | 0.03 | 0.3 | 0.2 |
| 2 | A | 32.2 | 5.0 | 0.01 | 0.21 | 0.11 |
| 3 | A | 32.9 | 4.8 | 0.01 | 0.20 | 0.21 |
| 4 | A | 31.9 | 4.7 | 0.02 | 0.19 | 0.24 |
| 5 | A | 32.5 | 5.5 | 0.02 | 0.19 | 0.30 |
| 6 | A | 31.5 | 5.3 | 0.03 | 0.25 | 0.25 |
| 7 | C | 31.9 | 4.7 | 0.01 | 0.25 | 0.23 |
| 8 | C | 32.0 | 4.8 | 0.01 | 0.26 | 0.21 |

| Sample | Kind | B | C | Be | Thermal expansivity $\mu/\mu_o \cdot$ °C. |
|---|---|---|---|---|---|
| 1 | B | 0.001 | 0.01 | — | 7.2 |
| 2 | A | 0.001 | 0.01 | 0.3 | 8.5 |
| 3 | A | 0.001 | 0.02 | 0.08 | 10.2 |
| 4 | A | 0.001 | 0.02 | 0.5 | 7.5 |
| 5 | A | — | 0.01 | 1.0 | 11.5 |
| 6 | A | — | 0.01 | 2.0 | 10.6 |
| 7 | C | 0.001 | 0.01 | 0.008 | 7.9 |
| 8 | C | 0.001 | 0.01 | 2.3 | 22.5 |

A; invention
B; conventional
C; comparative

TABLE 2.

| | | Mechanical properties | | |
|---|---|---|---|---|
| Sample | Kind | Tensile strength kg/mm² | 0.2% proof stress kg/mm² | Hardness Hv |
| 1 | B | 59.5 | 55.4 | 200 |
| 2 | A | 90.2 | 84.4 | 276 |
| 3 | A | 78.6 | 72.2 | 247 |
| 4 | A | 100.1 | 92.5 | 301 |
| 5 | A | 115.0 | 102.7 | 308 |
| 6 | A | 130.0 | 122.5 | 330 |
| 7 | C | 60.3 | 55.6 | 201 |
| 8 | C | 129.5 | 122.0 | 328 |

| | | After annealing | | |
|---|---|---|---|---|
| Sample | Kind | Tensile strength kg/mm² | 0.2% proof stress kg/mm² | Hardness Hv |
| 1 | B | 44.3 | 27.9 | 125 |
| 2 | A | 52.8 | 34.1 | 160 |
| 3 | A | 49.6 | 30.1 | 140 |
| 4 | A | 54.0 | 36.5 | 170 |
| 5 | A | 55.6 | 38.8 | 181 |
| 6 | A | 57.4 | 41.2 | 190 |
| 7 | C | 43.5 | 27.0 | 124 |
| 8 | C | 57.2 | 41.0 | 188 |

A; invention
B; conventional
C; comparative

TABLE 3

| Sample | Kind | Ni | Co | Cr | Mn | Si |
|---|---|---|---|---|---|---|
| 11 | B | 36.0 | — | 0.1 | 0.4 | 0.2 |
| 12 | C | 35.8 | 0.008 | 0.3 | 0.5 | 0.1 |
| 13 | C | 35.9 | 0.01 | 0.2 | 0.3 | 0.1 |
| 14 | C | 36.1 | 0.5 | 0.5 | 0.4 | 0.2 |
| 15 | C | 36.0 | 2.0 | 0.3 | 0.4 | 0.1 |
| 16 | C | 36.2 | 2.5 | 0.2 | 0.5 | 0.2 |
| 17 | C | 35.9 | 0.5 | 0.3 | 0.5 | 0.1 |
| 18 | A | 36.1 | 0.4 | 0.2 | 0.6 | 0.1 |
| 19 | A | 36.0 | 0.7 | 0.4 | 0.3 | 0.1 |
| 20 | A | 35.8 | 0.5 | 0.4 | 0.5 | 0.2 |
| 21 | C | 35.9 | 0.6 | 0.3 | 0.4 | 0.2 |

| Sample | Kind | B | C | Be | Thermal expansivity $\mu/\mu_o \cdot$ °C. |
|---|---|---|---|---|---|
| 11 | B | 0.001 | 0.01 | — | 17.5 |
| 12 | C | 0.002 | 0.01 | — | 17.2 |
| 13 | C | 0.003 | 0.02 | — | 16.8 |
| 14 | C | 0.002 | 0.01 | — | 17.8 |
| 15 | C | 0.001 | 0.01 | — | 25.1 |
| 16 | C | 0.003 | 0.02 | — | 32.1 |
| 17 | C | 0.004 | 0.01 | 0.008 | 17.2 |
| 18 | A | 0.002 | 0.01 | 0.01 | 17.4 |
| 19 | A | 0.002 | 0.01 | 0.5 | 18.9 |
| 20 | A | 0.004 | 0.008 | 2.0 | 20.1 |
| 21 | C | 0.003 | 0.005 | 2.3 | 25.1 |

A; invention
B; conventional
C; comparative

TABLE 4

| | | Mechanical properties | | |
|---|---|---|---|---|
| Sample | Kind | Tensile strength kg/mm² | Elongation % | Hardness Hv |
| 11 | B | 55.2 | 17.6 | 186 |
| 12 | C | 56.3 | 17.5 | 188 |
| 13 | C | 57.1 | 17.0 | 190 |
| 14 | C | 56.2 | 17.6 | 189 |
| 15 | C | 55.5 | 17.3 | 182 |
| 16 | C | 55.2 | 17.5 | 188 |
| 17 | C | 56.3 | 17.4 | 190 |
| 18 | A | 71.1 | 15.9 | 240 |
| 19 | A | 103.2 | 10.0 | 308 |
| 20 | A | 112.1 | 9.8 | 310 |
| 21 | C | 113.2 | 9.9 | 312 |

| | | After annealing | | | |
|---|---|---|---|---|---|
| Sample | Kind | Tensile strength kg/mm² | Elongation % | Hardness Hv | Etching factor |

TABLE 4-continued

| | | | | | |
|---|---|---|---|---|---|
| 11 | B | 43.2 | 25.5 | 125 | 1.7 |
| 12 | C | 43.0 | 26.8 | 123 | 1.8 |
| 13 | C | 42.8 | 24.2 | 120 | 2.0 |
| 14 | C | 41.5 | 27.2 | 121 | 2.5 |
| 15 | C | 40.6 | 26.3 | 120 | 2.8 |
| 16 | C | 42.3 | 24.1 | 129 | 2.8 |
| 17 | C | 43.2 | 27.1 | 131 | 2.4 |
| 18 | A | 45.2 | 22.3 | 142 | 2.5 |
| 19 | A | 51.5 | 20.1 | 172 | 2.2 |
| 20 | A | 55.3 | 17.4 | 181 | 2.3 |
| 21 | C | 55.4 | 17.0 | 184 | 2.5 |

A; invention
B; conventional
C; comparative

TABLE 5

| Sample | Kind | Ni | Co | Cr | Mn | Si |
|---|---|---|---|---|---|---|
| 31 | B | 36.0 | — | 0.05 | 0.3 | 0.1 |
| 32 | A | 35.9 | 0.01 | 0.2 | 0.3 | 0.1 |
| 33 | A | 36.2 | 0.3 | 0.4 | 0.4 | 0.1 |
| 34 | A | 35.8 | 0.8 | 0.6 | 0.3 | 0.1 |
| 35 | A | 36.1 | 0.2 | 0.9 | 0.4 | 0.2 |
| 36 | C | 35.9 | 0.1 | 1.8 | 0.3 | 0.1 |

| Sample | Kind | B | C | Thermal expansivity $\mu/\mu_0 \cdot$ °C. |
|---|---|---|---|---|
| 31 | B | 0.001 | 0.01 | 17.5 |
| 32 | A | 0.007 | 0.02 | 17.7 |
| 33 | A | 0.002 | 0.01 | 17.9 |
| 34 | A | 0.001 | 0.01 | 18.2 |
| 35 | A | 0.003 | 0.02 | 18.8 |
| 36 | C | 0.002 | 0.01 | 27.5 |

A; invention
B; conventional
C; comparative

TABLE 6

| Sample | Kind | Annealing temperature °C. | 0.2% proof stress kg/mm$^2$ | Young's modulus kg/mm$^2$ |
|---|---|---|---|---|
| 311 | B | — | 46.0 | 15800 |
| 312 | | 900 | 24.6 | 13500 |
| 313 | | 1100 | 23.2 | 12000 |
| 321 | A | — | 44.6 | 16000 |
| 322 | | 700 | 31.4 | 15500 |
| 323 | | 900 | 24.4 | 15000 |
| 324 | | 1100 | 22.6 | 13000 |
| 331 | A | — | 43.0 | 16000 |
| 332 | | 900 | 24.2 | 15000 |
| 333 | | 1100 | 21.1 | 14000 |
| 341 | A | — | 42.0 | 16300 |
| 342 | | 900 | 23.1 | 15200 |
| 343 | | 1100 | 20.6 | 14200 |

TABLE 6-continued

| Sample | Kind | Annealing temperature °C. | 0.2% proof stress kg/mm$^2$ | Young's modulus kg/mm$^2$ |
|---|---|---|---|---|
| 351 | A | — | 41.5 | 16500 |
| 352 | | 900 | 22.4 | 15000 |
| 353 | | 1100 | 19.8 | 14600 |
| 361 | C | — | 40.8 | 17000 |
| 362 | | 900 | 20.2 | 15500 |
| 363 | | 1100 | 18.8 | 14800 |

A; invention
B; conventional
C; comparative

TABLE 7

| Sample | Kind | Temperature °C. | 0.2% proof stress |
|---|---|---|---|
| 315 | B | 100 | 17.0 |
| 316 | | 200 | 9.2 |
| 325 | A | 100 | 16.8 |
| 326 | | 200 | 8.9 |
| 335 | A | 100 | 16.0 |
| 336 | | 200 | 8.4 |
| 345 | A | 100 | 15.4 |
| 346 | | 200 | 8.2 |
| 355 | A | 100 | 14.6 |
| 356 | | 200 | 7.8 |
| 365 | C | 100 | 13.9 |
| 366 | | 200 | 7.5 |

We claim:

1. A method for producing a shadow mask of a Fe-Ni-Co alloy comprising the steps of:

preparing a plate consisting essentially of 30 to 34% by weight of Ni, 0.1% by weight or less of Cr, 4 to 6% by weight of Co, 1% by weight or less of Mn, 0.5% by weight or less of Si, 0.1% by weight or less of B, 0.1% by weight or less of C, 0.01 to 2.0% by weight of Be and Fe in balance;

forming fine pores in said plate by means of etching;

annealing said plate at a temperature in a range from 800° to 1200° C. for 5 minutes or longer within an inert gas or hydrogen gas environment; and applying plastic deformation to said plate at a temperature of 300° C. or lower.

2. A method as claimed in claim 1 in which preparation of said plate is carried out by means of forging at a temperature in a range form 1200° to 1400° C.

3. A method as claimed in claim 1 in which pore formation is carried out by forming a perforated protective wafer on the surface of said plate, immersing said plate into an etching bath and removing said protective wafer thereafter.

4. A method as claimed in claim 1 in which said annealing is carried out for 5 to 60 min.

* * * * *